United States Patent [19]

Numerowski

[11] 4,032,288

[45] June 28, 1977

[54] ROOFING SHINGLE MINERAL FILLER HEATER

[75] Inventor: Kenneth J. Numerowski, Chicago, Ill.

[73] Assignee: U.I.P. Engineered Products Corporation, Elk Grove Village, Ill.

[22] Filed: Oct. 16, 1975

[21] Appl. No.: 622,850

[52] U.S. Cl. ..... 432/189; 126/343.5 A; 432/95; 432/177

[51] Int. Cl.[2] ..... F27D 1/08; F27D 17/00

[58] Field of Search ..... 432/95, 102, 189, 176, 432/177, 101; 126/343.5 A

[56] References Cited

UNITED STATES PATENTS

| | | | |
|---|---|---|---|
| 1,147,706 | 7/1915 | Clymer | 432/102 X |
| 2,202,090 | 5/1940 | Colbert | 432/95 X |
| 2,518,490 | 8/1950 | Parry | 432/95 |
| 3,071,358 | 1/1963 | Blaha | 432/95 |
| 3,163,888 | 1/1965 | Shattuck | 432/102 X |
| 3,954,391 | 5/1976 | Gottlieb | 432/95 |

*Primary Examiner*—John J. Camby
*Attorney, Agent, or Firm*—Ronald E. Barry

[57] ABSTRACT

A mineral filler heater assembly for heating mineral filler by directing hot discharge gases from a regenerating system or a thermal oxidizer in heat exchange relation to the mineral filler, and including fluid fuel burners connected to maintain the temperature of the discharge gases above a predetermined minimum, the regenerating system including a modulating damper assembly responsive to the pressure of the discharge gases at the entrance to the heater to control the amount of recycled gases.

7 Claims, 3 Drawing Figures

ROOFING SHINGLE MINERAL FILLER HEATER

BACKGROUND OF THE INVENTION

The filler heater of the present invention forms a part of the system or process for manufacturing roofing shingles. Roofing shingles of the type contemplated herein are composed of a carrier web, either mineral or organic, sealed with asphalt and coated with asphalt stabilized with mineral filler. A mineral surfacing material is provided on the web and the web is finally surfaced with slate granules. The asphalt stabilized with the mineral filler generally comprises approximately 55 percent of the total weight of the roofing shingle.

In the process of producing the shingle, the carrier web is first sealed by passing it through a hot bath of asphalt. The fume emissions generated from the hot bath contain pollutants which must be removed before discharge to the atmosphere. These pollutants develop from the normal vaporization of the hot asphalt, the moisture in the carrier web which is vaporized to steam as it passes through the hot asphalt and churning of the hot asphalt by the movement of the web. These fumes or pollutants are collected in a hood enclosure which is ducted to a thermal oxidizer for thorough resolution of all hydrocarbons. The heated fumes are passed over a series of asphalt ducts or tubes to heat the asphalt as it passes to the asphalt bath. The waste heat from the thermal oxidizer is then ducted to a mineral filler heater.

The web, which has now been sealed with asphalt, is then coated with asphalt stabilized with mineral filler. This coating process is critical since it requires a controlled asphalt viscosity in order to achieve uniformity in the distribution of the stabilized asphalt onto the web. Adding mineral filler at ambient temperature in large quantities to the asphalt without having control of the filler temperature will result in wide variances in the asphalt temperature. The percentage of mineral filler added to the heated asphalt has been limited because of this drop in temperature of the stabilized asphalt below the required application temperature as a result of the addition of cooled filler.

SUMMARY OF THE INVENTION

The mineral filler heater of the present invention provides for greater efficiency in the manufacture of roofing shingles through the use of mineral filler heated by the waste heat from the thermal oxidizer as well as recirculation of the hot filler gases. In this regard, Underwriter's Laboratory has recently provided for an increase in the allowable amount of the mineral filler in stabilized asphalt from 55 to 60 percent by weight. This increase in mineral filler also results in a substantial cost saving in the manufacture of the roofing shingle. This will become evident when it is realized that 81,000 tons of stabilized asphalt coating is used anually. Asphalt costs $80.00 per ton, while mineral filler costs $10.00 per ton. The increase in the amount of filler in the stabilized asphalt of five percent now allowed by Underwriters, can result in an overall cost saving of some $283,500.00 per year. The fire retardation charcteristics of the single is also increased because of the noncombustible characteristic of the mineral filler.

The addition of the mineral filler at a constant temperature of approximately 275° F. allows for the addition of the maximum allowable amount of mineral filler (60 percent by weight) to the hot asphalt. The asphalt is normally supplied at a temperature of 490° F. The resulting temperature of the stabilized asphalt available for coating will be 410° F. which is the optimum temperature for coating the sealed asphalt web. The increase in the amount of mineral filler material also results in a reduction in asphalt which is a petroleum product.

DRAWINGS

DESCRIPTION OF THE INVENTION

Figure 1:
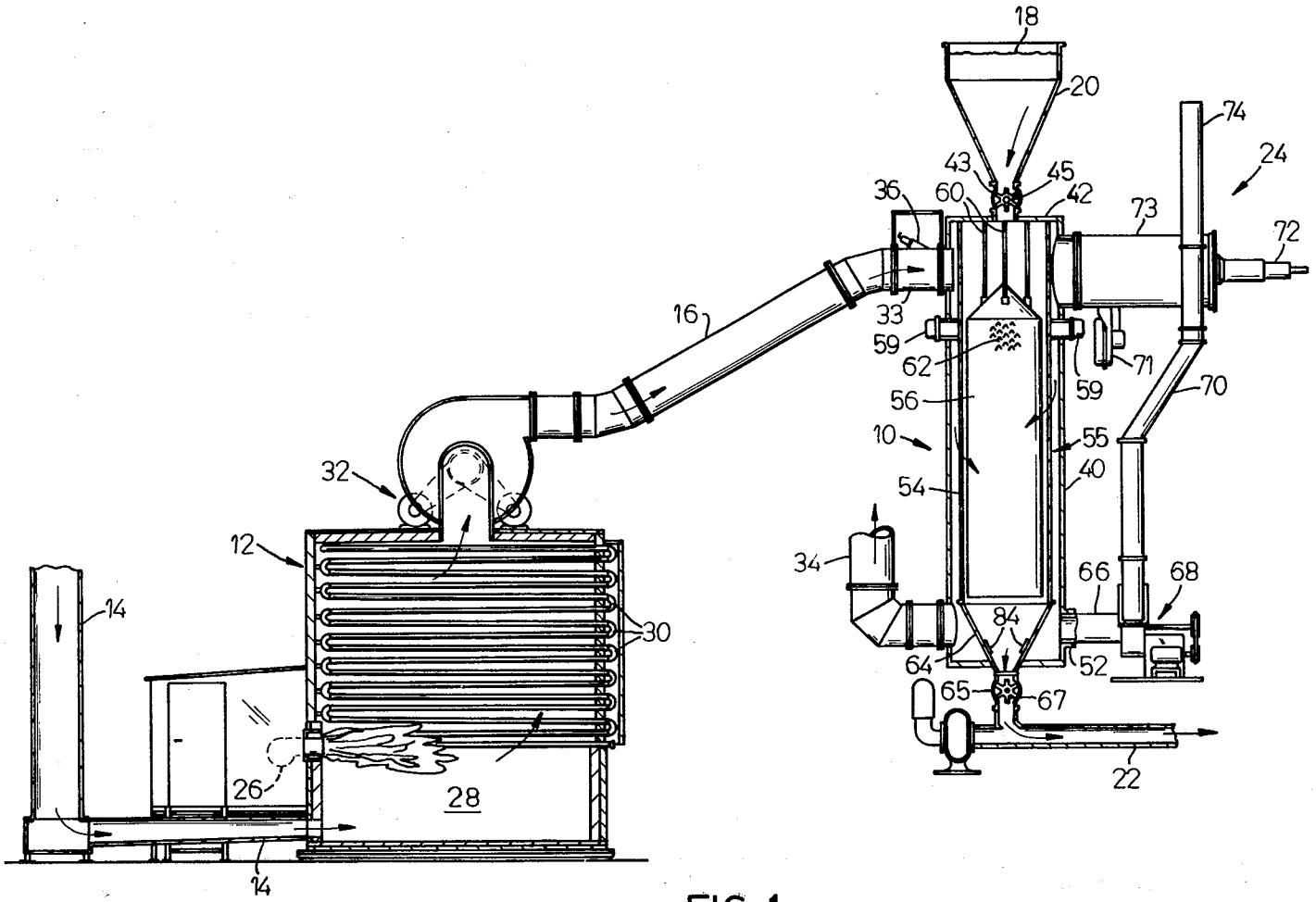
FIG. 1 is a schematic view of the mineral filler heater according to the invention shown connected to an asphalt heater thermal oxidizer.

The filler heater 10 as seen in FIG. 1, is shown as a part of a system for manufacturing roofing shingles. This system generally includes a thermal oxidizer 12 having an inlet duct 14 connected to a web saturator (not shown) for receiving the fume emissions from the saturator. The fume emissions pass through the thermal oxidizer 12 where a substantial amount of the heat generated to remove the hydrocarbons from the fume emissions is used to heat asphalt flowing through fluid conduit 30 in the thermal oxidizer. The heat remaining in the hot gases discharged from the thermal oxidizer is recovered in the filler heater by directing the hot gases through a duct 16 into the filler heater 10. Mineral filler 18 such as crushed limestone is fed from a reservoir 20 into the filler heater 10 and is discharged through a discharge duct 22. The preheated mineral filler 18 is then combined with hot asphalt and applied to the sealed roofing shingle web.

The filler heater 10 is also provided with a waste heat regenerator system 24 which is used for heating the mineral filler. The regenerator system recovers the heat of the hot gases discharged from the filler heater by recirculating the hot gases back to the filler heater.

Thermal Oxidizer

The thermal oxidizer 12 is of the type shown in U.S. Pat. No. 3,880,143, issued on Apr. 29, 1975 and entitled "Combination Fume Oxidizer and Asphalt Heater". The thermal oxidizer includes a fuel burner 26 mounted on the side wall of a combustion chamber 28. The fuel burner 26 is used to raise the temperature of the fume emissions sufficiently to remove any unburned hydrocarbons. The conduits 30 are mounted in the oxidizer 12 for circulating liquid petroleum products such as asphalt through the oxidizer. The heated fume emissions pass around the conduits 30 raising the temperature of the liquid asphalt to a maximum temperature of 490° F. Asphalt heated to temperatures above 490° undergoes characteristic changes and also requires greater safety precautions in handling. The heated asphalt can be used either in the asphalt bath in the web saturator or combined with heated mineral filler to form the asphalt stabilizer.

The hot gases discharged from the thermal oxidizer 12 are forced through the duct 16 into a combustion chamber 33 by means of a two-speed fan 32 provided on the thermal oxidizer 12. The fan 32 is usually operated at high speed when fume emissions are being introduced into combustion chamber 28.

More particularly, the fume emissions from the web saturator enter the duct 14 at a temperature of approximately 200° F. and are discharged into the combustion chamber 28 in the thermal oxidizer. The fuel burner 26 is used to raise the combustion chamber temperature 1400° F. for thorough resolution of the hydrocarbons in the fume emissions. Generally, the liquid asphalt in the fluid conduits 30 in the thermal oxidizer absorb up to 50 percent of the heat generated in the combustion chamber 28. The temperature of the hot gases remaining after passing through the thermal oxidizer will be at an approximate temperature of 700°–1000° F. The temperature of the hot gases flowing through the ducts 16 into the combustion chamber 33 can be raised by means of a fuel burner 36 provided in the combustion chamber 33. The gases are discharged from the combustion chamber into the filler heater 10 at a temperature of 700° F. to 1000° F. depending on the discharge temperature of the mineral filler as described hereinafter. The hot gases are then exhausted to atmosphere through exhaust duct or stack 34.

Mineral Filler Heater

Figure 2:
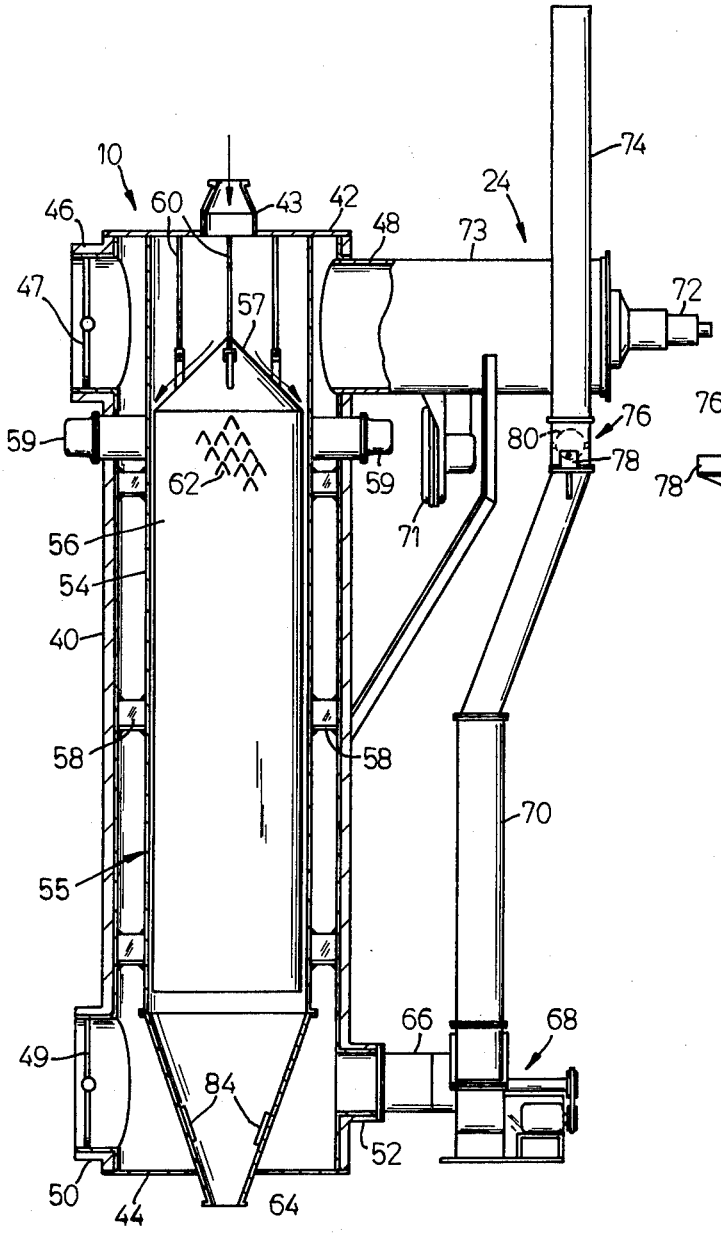
FIG. 2 is a view in elevation partly broken away to show the flow paths through the filler heater.
Figure 3:
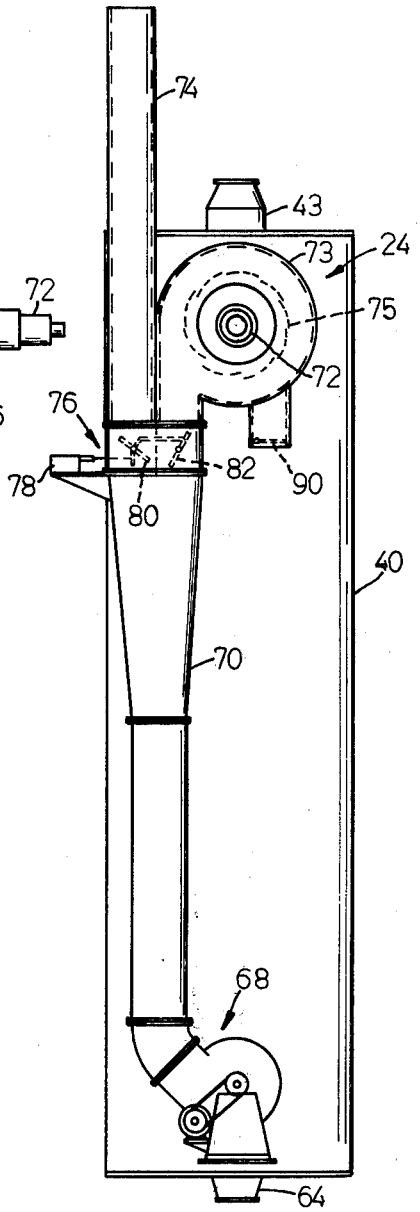
FIG. 3 is a side view in elevation showing the hot gas recirculation system for the filler heater.

Referring to FIGS. 2 and 3, the filler heater 10 shown is designed to use either the hot gases discharged from the thermal oxidizer 12 or from the regenerator system 24 to heat the mineral filler 18. In this regard, the filler heater 10 includes a hollow cylindrical jacket 40 which is closed at the top by a top cover assembly 42 and at the bottom by a bottom cover assembly 44. Means are provided at the upper end of the jacket 40 for admitting high temperature gases from the combustion chamber 33 into the jacket 40 in the form of an inlet opening 46. Hot gases from the regenerating system 24 are admitted into the jacket 40 through an inlet opening 48. Hot gases from the thermal oxidizer are discharged from the filler heater 10 through an outlet opening 50 into the exhaust stack 34. Hot gases to be recycled through the regenerator system 24 are discharged from the jacket 40 through an outlet opening 52.

The inlet and outlet openings 46 and 50, respectively, can be closed while the regenerating system 24 is operating by means of damper valves 47 and 49. The valves 47 and 49, as shown, are manually actuated. However, automatic control can be provided if desired. The damper valves 47 and 49 are closed whenever the regenerating system 24 is operating.

The reservoir 20 for the mineral filler 18 is mounted on the cover assembly 42 and is connected to the jacket 40 by means of a spout 43. The flow of mineral filler 18 into the jacket 40 is controlled by means of a rotary vane feeder 45 provided in the spout 43.

Means are provided within the jacket 40 for defining a diverse flow path for the mineral filler 18 and to place the mineral filler in heat exchange relation with the high temperature gases admitted to the jacket 40. Such means is in the form of a heat exchange assembly 55 which includes a hollow cylindrical housing 54 and a cylindrical member 56. The hollow cylindrical housing 54 is centered in the jacket 40 in a spaced relation thereto by means of a plurality of supports 58 which also act to deflect or circulate the hot gases around the exterior of the housing 54.

Filler material heated in the heater 10 is directed by a conical chute 64 into a spout 65 at the bottom of the cylindrical housing 54. Means are provided in the spout 65 of the reservoir 64 for maintaining a continuous or intermittent flow of hot mineral filler 18 into the discharge duct 22. Such means is shown in the form of a second rotary vane feeder 67.

The cylindrical member 56 is suspended within the housing 54 by means of a number of support rods 60 and is held in a spaced relation to the housing 54 by a series of chevron-shaped deflector 62 mounted on the housing 54. The filler 18 as it enters the housing 54 is guided into the space between the housing 54 and the member 56 by means of a conical deflector 57 provided at the top of the member 56. The chevron deflectors 62 provide a diverse flow path for the filler material and act as heat transfers fins as the filler flows by gravity from the top of the housing 54 to the chute 64.

Means can be provided to maintain a continuous flow of the filler material through the heat exchange assembly 55. Such means is in the form of a number of mechanical vibrators 59 provided around the top of the housing 54. Conventional electromagnetic vibrators are shown, however, other types can also be used.

Regenerating System

Means are provided for increasing the efficiency of the filler heater 10 by recycling hot gases that flow through the filler heater. Such means is in the form of the regenerative system 24 which includes a fuel burner 72 mounted on a combustion chamber 73 in the opening 48. Combustion air is circulated into the combustion chamber 73 by a fan 71 and is mixed with the fuel from burner 72 and directed into the jacket 40. The hot gases which flow through the filler heater 10 are recycled to the combustion chamber 73 by means of a blower or fan 68 mounted on the end of a duct 66 on outlet 52. The hot gases are forced through the duct 70 into a air distributor 75 on the combustion chamber 73 or discharged to atmosphere through exhaust duct 74.

Means are provided within the duct 70 for controlling the amount of hot gases directed into the combustion chamber 73 and exhaust duct 74. Such means is in the form of a standard modulating damper assembly 76 which includes a pressure sensor 78 that responds to the pressure of the hot gases within the heat exchange assembly 55 to control separate damper valves 80 and 82 positioned within duct 70. In this regard, damper valve 80 controls the flow of hot gases to the exhaust duct 74 and damper valve 82 controls return flow of hot gases to the combustion chamber 73. The damper valves 80 and 82 are connected to move in equal and opposite directions so that opening of one valve closes the other valve and vice versa. The pressure sensor 78 senses the pressure in the heat exchange assembly 55 and opens the valve 80 to exhaust duct 74 whenever the burner 72 is actuated to increase the temperature of the recirculating gases. Damper valve 80 is normally closed whenever damper valves 47 and 49 are open.

The temperature of the gases entering the filler heater 10 can be controlled by means of a heat sensing device 84 located in the conical chute 64 at the end of the cylinder 54. The heat sensing device 84 senses the temperature of the mineral filler in the chute 64. The burners 36 and 72 are connected to the sensing device 84 and are ignited to increase the temperature of the hot gases as the gases enter the jacket 40 if the mineral filler temperature drops below a predetermined minimum.

The mineral filler 18 in reservoir 120 is generally at an ambient temperature of 70° F. The filler heater 10 is used to raise the filler temperature to 275° F. This is considered to be the optimum temperature required to add 60 percent filler by weight to asphalt at a temperature of 490° F. The resulting stablilized asphalt temperature will then be 410° F. The minimum operating temperature for the stablized asphalt is 365° F.

If the filler heater 10 is operating on hot gases from the thermal oxidizer, additional heat from burner 36 will be added whenever the filler material temperature drops below 275° F. If the filler heater 10 is operating on the regenerative system 24, combustion air and fuel is brought in at burner 72 and mixed in chamber 73 with circulating gases from duct 70. The temperature in the chamber 73 will normally be maintained between 700° F. and 1000° F., and can be increased or decreased according to the temperature of the filler material in chute 64.

Means are provided in the regenerative system 24 to purge the filler heater at periodic intervals. Such means includes a barometric damper 90 mounted on the air distributor on the combustion chamber 73. To purge the system, the pressure sensor 78 is automatically actuated to close the valve 82 and to open the valve 80 so that all of the gases are blown out through the stack 74. Barometric damper 90 on combustion chamber 73 will open due to the drop in pressure within the filler heater drawing in fresh air through the air distributor to purge the system.

Résumé

The filler heater assembly of the present invention provides economic advantages both in money and energy conservation. In annual savings, the amount of asphalt (an oil based product) saved is over 7,000 tons or a 14 percent reduction. These savings are realized as well as the elimination of pollutants through the use of the discharge product from the thermal oxidizer.

The embodiments of the invention in which an exclusive property or privilege is claimed are defined as follows:

1. An assembly for heating mineral filler prior to combining the filler with a heated liquid asphalt for coating roofing shingles, said assembly comprising:

a mineral filler heater, a thermal oxidizing means for heating fume emissions to remove hydrocarbons, means connecting said oxidizing means to said heater for directing the high temperature fume emissions from the thermal oxidizing means to said filler heater, a first burner in said directing means for maintaining the fume emissions at a predetermined temperature, a regenerating system connected to said filler heater for reheating discharge gases and redirecting the higher temperature discharge gases into the inlet to the filler heater, a second burner in said regenerating system to maintain said recycled gas at a predetermined minimum, means continuously moving mineral filler through said filler heater, and means for selectively connecting one of said thermal oxidizing means and regenerating system to said filler heater.

2. the assembly according to claim 1 wherein said filler heater includes an outer cylindrical jacket, a heat exchange assembly and gas deflecting supports centering said assembly within said jacket in a spaced relation thereto to define a flow path for the high temperature gases.

3. The assembly according to claim 2 wherein said heat exchange assembly includes a housing and a cylindrical member supported within said housing for directing filler in heat exchange relation to said housing.

4. The assembly according to claim 1 including means responsive to the mineral filler discharge temperature controlling said first and second burners.

5. The assembly according to claim 1 wherein said regenerating system includes a modulating damper assembly connected to respond to the pressure of the hot gases in the regenerating system to control the discharge of hot gases to atmosphere.

6. A mineral filler heater for an asphalt stabilizer, said heater comprising:

a jacket, a heat exchanger mounted within and spaced from said jacket, said heat exchanger including a housing and a cylindrical member mounted within said housing in a spaced relation thereto, a mineral filler reservoir mounted on said jacket, means for feeding mineral filler from said reservoir into the space between said housing and cylindrical member, filler deflecting means positioned in the space between said cylindrical member and said housing for deflecting said mineral filler into diverse flow paths in heat exchange relation to the inner surface of said housing, a combustion chamber, means directing hot gases from said combustion chamber into said jacket in heat exchange relation to the outside surface of said housing, means for directing discharge gases from said jacket back to said combustion chamber, and pressure responsive means connected to said discharge gas directing means for selectively directing discharge gases to said combustion chamber or to the atmosphere.

7. The heater according to claim 6 including means connected to said jacket for directing discharge gases from a thermal oxidizing means into said jacket.

* * * * *